US009827508B2

(12) United States Patent
Li et al.

(10) Patent No.: US 9,827,508 B2
(45) Date of Patent: Nov. 28, 2017

(54) CIRCULATING DYNAMIC VEHICLE VIEWING SYSTEM

(71) Applicant: SHENZHEN OCT VISION INC., Shenzhen, Guangdong (CN)

(72) Inventors: Jian Li, Guangdong (CN); Hongguang Wen, Guangdong (CN); Baoluo Jia, Guangdong (CN)

(73) Assignee: SHENZHEN OCT VISION INC., Shenzhen (CN)

( * ) Notice: Subject to any disclaimer, the term of this patent is extended or adjusted under 35 U.S.C. 154(b) by 0 days.

(21) Appl. No.: 15/127,415

(22) PCT Filed: Mar. 6, 2015

(86) PCT No.: PCT/CN2015/073755
§ 371 (c)(1),
(2) Date: Sep. 19, 2016

(87) PCT Pub. No.: WO2016/123833
PCT Pub. Date: Aug. 11, 2016

(65) Prior Publication Data

US 2017/0232359 A1 Aug. 17, 2017

(30) Foreign Application Priority Data

Feb. 3, 2015 (CN) ..... 2015 1 0054940

(51) Int. Cl.
*A63J 25/00* (2009.01)
*A63J 5/00* (2006.01)
(Continued)

(52) U.S. Cl.
CPC ..... *A63J 25/00* (2013.01); *A63J 5/00* (2013.01); *A63J 5/12* (2013.01); *A63J 2005/002* (2013.01)

(58) Field of Classification Search
CPC ..... A63G 31/00; A63G 31/14; A63G 31/16; G09B 9/00; G09B 9/04; G09B 9/12; A63J 5/00; A63J 5/12; A63J 25/00
(Continued)

(56) References Cited

U.S. PATENT DOCUMENTS 7,094,460 B2 * 8/2006 Aylward ..... B41M 5/41 428/141
7,484,460 B2 * 2/2009 Blum ..... A63G 21/14 104/53

(Continued)

*Primary Examiner* — Kien Nguyen

(57) ABSTRACT

Provided is a circulating dynamic vehicle viewing system; the system at least comprises: two circulating dynamic vehicles (100), i.e. a first cycled vehicle (110) and a second cycled vehicle (120); a drive device used for driving the circulating vehicles (100) in motion; a rocking platform used for controlling the circulating vehicles (100) in reciprocating motion, i.e. a first rocking platform (200) and a second rocking platform (300), the first rocking platform (200) and the second rocking platform (300) are each provided with several independent motion platform apparatuses (210) used for securing the circulating dynamic vehicles (100); the independent motion platform apparatuses (210) are provided with airbag apparatuses used for controlling the up and down movement of the circulating dynamic vehicles. When a viewer is seated on the circulating dynamic vehicles (100), bump and drop movements are simulated, providing a sense of realism and "really there" three-dimensionality.

10 Claims, 5 Drawing Sheets

(51) Int. Cl.
*A63J 5/12* (2006.01)
*A63G 31/16* (2006.01)

(58) Field of Classification Search
USPC ..... 472/59–61, 130; 434/29, 30, 35, 55, 58, 434/62
See application file for complete search history.

(56) References Cited

U.S. PATENT DOCUMENTS

2005/0042578 A1* 2/2005 Ammon ..... G09B 9/04 434/62
2009/0246741 A1* 10/2009 Soodeen ..... G09B 9/12 434/55

* cited by examiner

CIRCULATING DYNAMIC VEHICLE VIEWING SYSTEM

TECHNICAL FIELD

The present disclosure relates generally to the technical field of a movable projection, and more particularly, to a circulating dynamic vehicle viewing system.

BACKGROUND

With the development of science and technology amusement industry, people are keeping pursuing more exciting and comfortable entertainment. Among the numerous entertainment activities, the main entertainment project organically combining the running machine with the film and television is an important research topic at present. In the prior art, the viewing system has single function. The audience can not feel immersive even when watching the 3D film. Moreover, in the prior art, the audience did not have a viewing experience of sitting in the city bus, watching 3D film on the bracket screen and 2D film on the hemispheric screen. Meanwhile, the bus body coordinates with the film content to simulate actions such as bumping, falling and so on during the film viewing.

Therefore, the prior art has yet to be improved and developed.

SUMMARY

The object of the present application is to provide a circulating dynamic vehicle viewing system, aiming at the defects of the prior art that the seat is secured or can only rotates, rather than simulate actions such as bumping, falling and so on according to the film plot during the film viewing, thus giving the audience who watching the film no strong stereo feeling and liveness.

In one aspect, a circulating dynamic vehicle viewing system is provided, which at least comprising: two circulating dynamic vehicles, i.e. a first circulating dynamic vehicle, a second circulating dynamic vehicle; a drive device used for driving the circulating dynamic vehicles in motion; a rocking platform used for controlling the circulating dynamic vehicles in reciprocating motion, i.e. a first rocking platform and a second rocking platform; wherein the first rocking platform and the second rocking platform are each provided with several independent motion platform apparatuses used for securing the circulating dynamic vehicles; wherein the independent motion platform apparatuses are provided with an airbag apparatus used for controlling an up and down movement of the circulating dynamic vehicles.

In the circulating dynamic vehicle viewing system according to the present application, the first rocking platform is provided with a bracket screen at its left side and its right side, respectively. The first rocking platform is further provided with an arc screen door connecting the bracket screens at its right side and left side.

In the circulating dynamic vehicle viewing system according to the present application, the second rocking platform is provided with a hemispheric screen.

In the circulating dynamic vehicle viewing system according to the present application, the first rocking platform is provided with a ceiling on which several projection apparatuses for projecting are arranged, i.e. a first projection apparatus, a second projection apparatus, and a third projection apparatus.

In the circulating dynamic vehicle viewing system according to the present application, two first projection apparatuses for projecting onto the bracket screen are arranged at the left side and the right side of the ceiling, respectively.

In the circulating dynamic vehicle viewing system according to the present application, two second projection apparatuses for projecting onto the hemispheric screen are arranged at the front of the ceiling.

In the circulating dynamic vehicle viewing system according to the present application, a third projection apparatus for projecting onto the arc screen door is arranged at a middle position of the front of the ceiling.

In the circulating dynamic vehicle viewing system according to the present application, a guide rail is arranged under the circulating dynamic vehicle which is slidably connected to the guide rail.

In the circulating dynamic vehicle viewing system according to the present application, the first rocking platform is provided with four independent motion platforms, and the second rocking platform is provided with four independent motion platforms, wherein the independent motion platforms coordinate with wheels of the circulating dynamic vehicle for securing the circulating dynamic vehicle.

In the circulating dynamic vehicle viewing system according to the present application, the drive device is used for driving the circulating dynamic vehicles in motion via a roller.

By implementing the circulating dynamic vehicle viewing system according to the present application, a rocking platform provided with independent motion platform apparatuses having an airbag apparatus is provided, such that when watching the different films on the bracket screen, the hemispheric screen and the arc screen door, the circulating dynamic vehicle travelling on the rocking platform can move upward, downward, leftward, rightward, forward and backward under the control of the drive device, and the circulating dynamic vehicle can have a reciprocating motion on the rocking platform, thus giving the audience strong realistic feeling and livenesss.

DETAILED DESCRIPTION OF THE PREFERRED EMBODIMENT

The present application relates to a circulating dynamic vehicle viewing system. These and other advantage, aspect and novel features of the present invention, as well as details of an illustrated embodiment thereof, will be more fully understand from the following description and drawings. While various embodiments of the present invention has been presented by way of example only, and not limitation.

Figure 1:
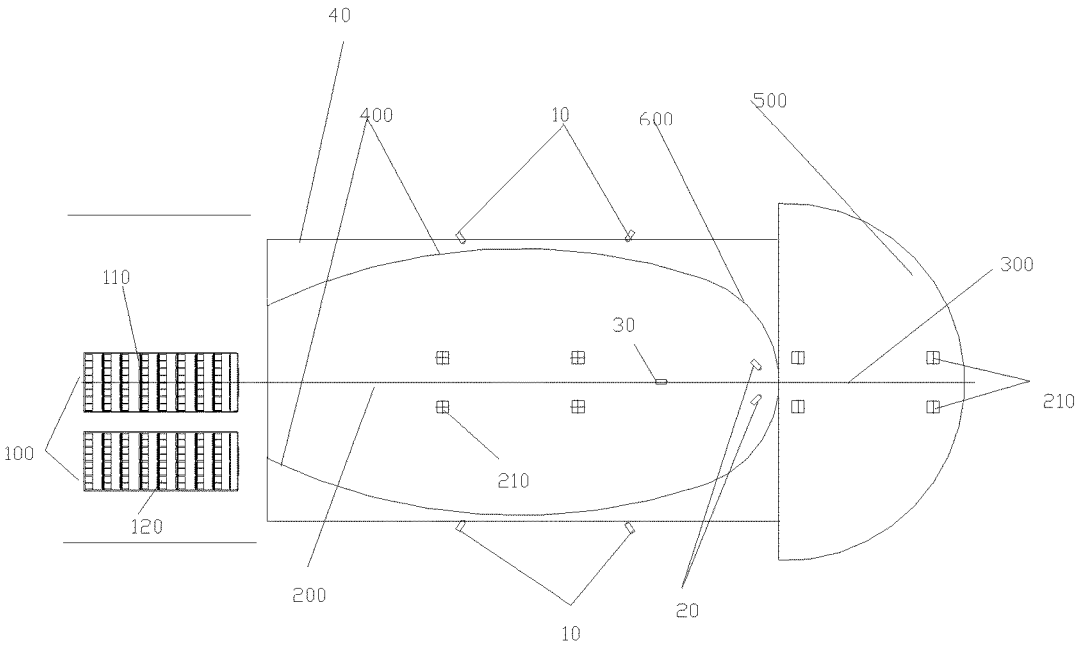
FIG. 1 is a top view of the circulating dynamic vehicle viewing system according to the present application.
Figure 2:
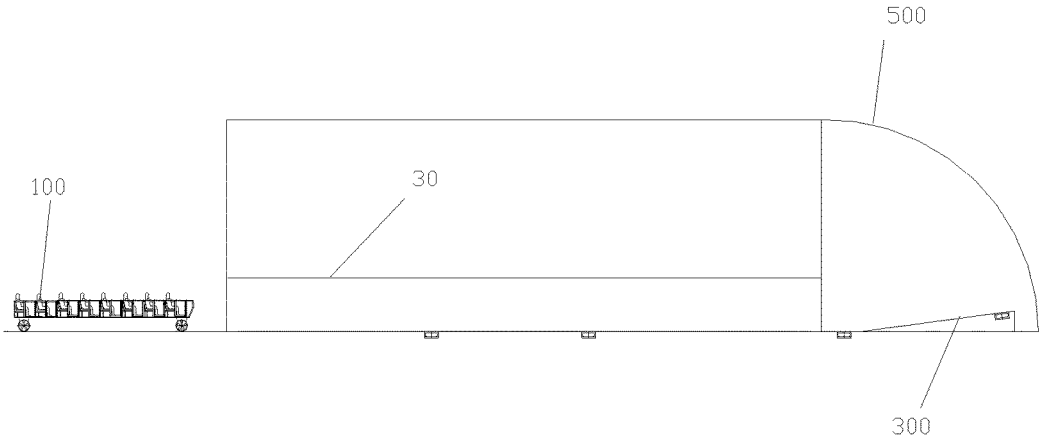
FIG. 2 is a side view of the circulating dynamic vehicle viewing system according to the present application.
Figure 3:
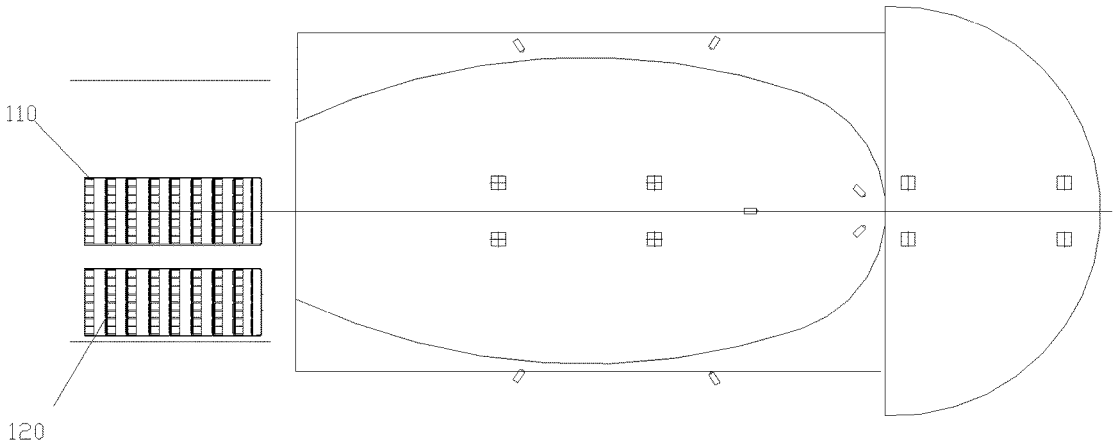
FIGS. 3-10 are diagrams showing that the circulating dynamic vehicle enters the viewing system for viewing according to a preferable embodiment of the present application.
Figure 4:
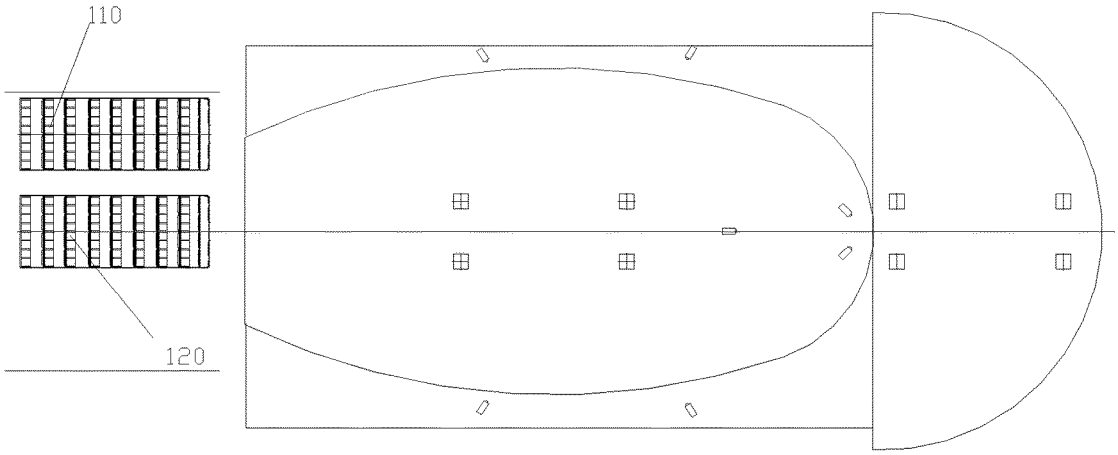
Figure 5:
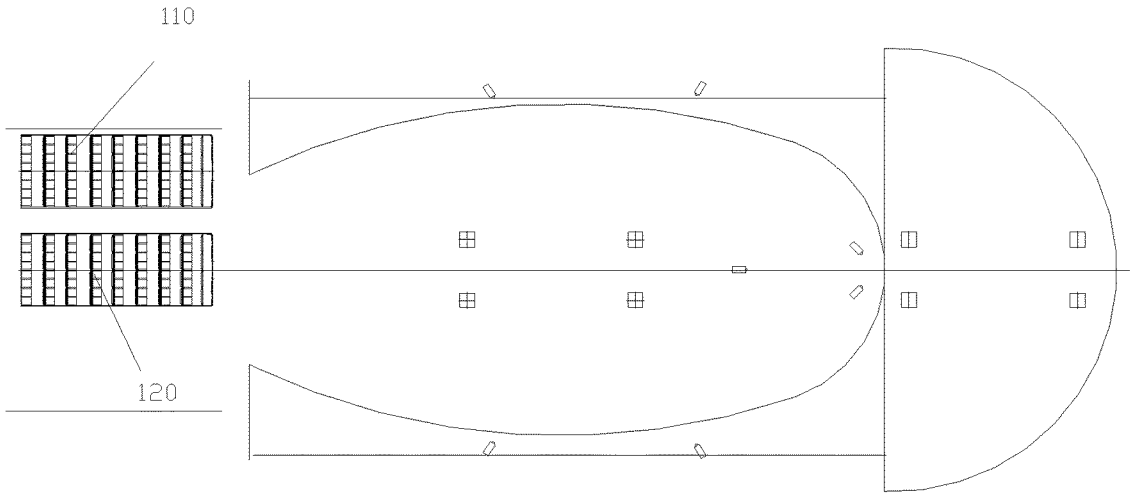
Figure 6:
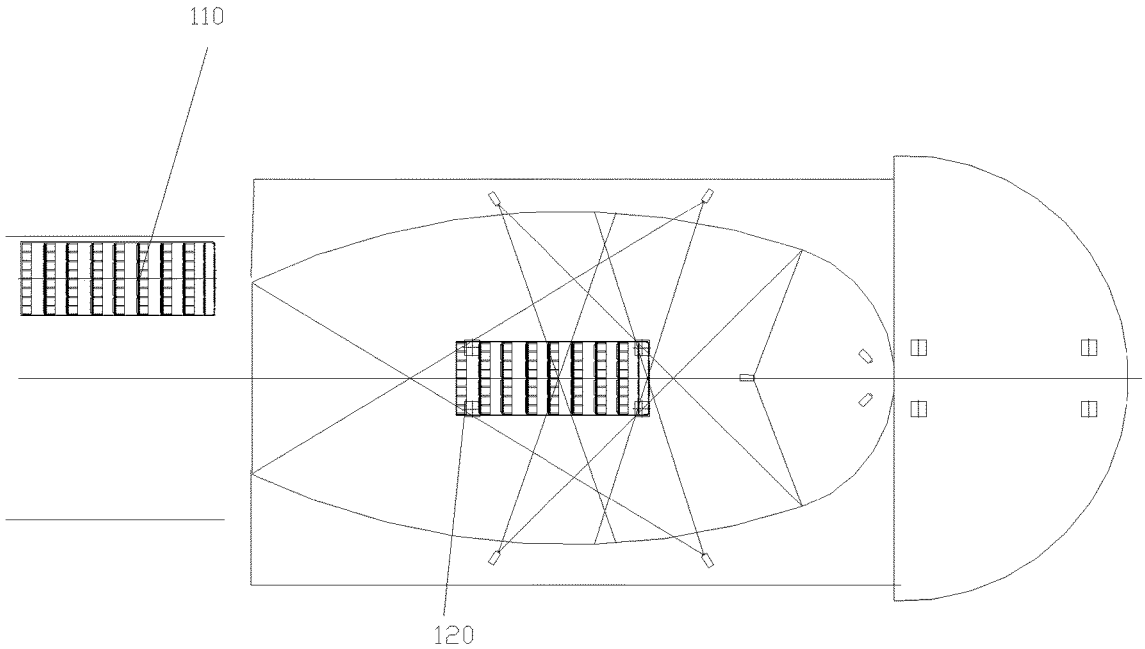
Figure 7:
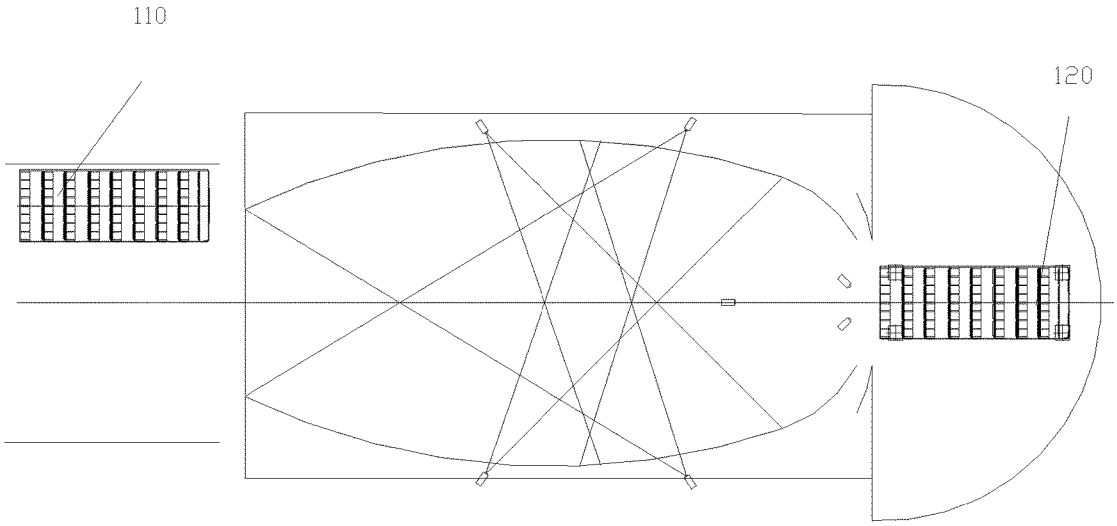
Figure 8:
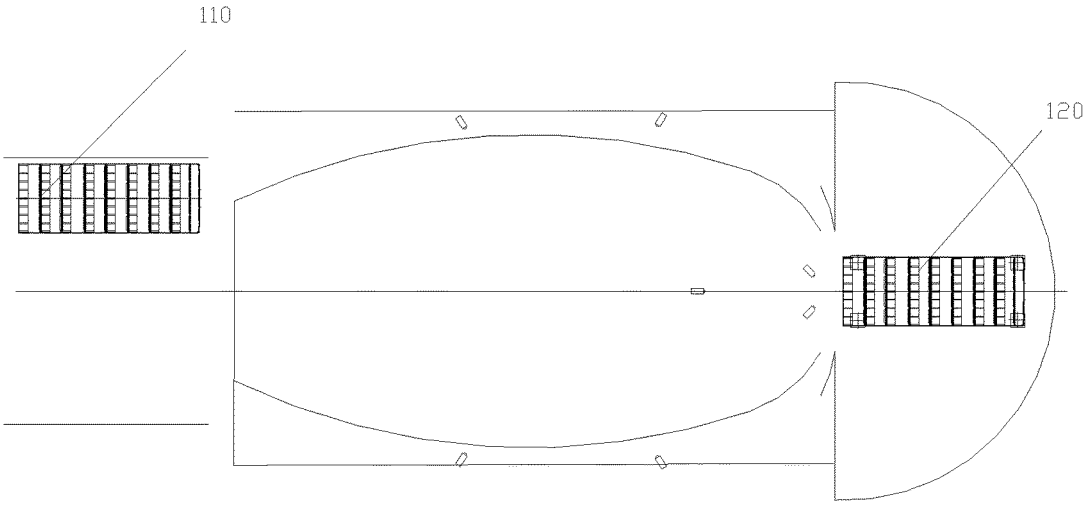
Figure 9:
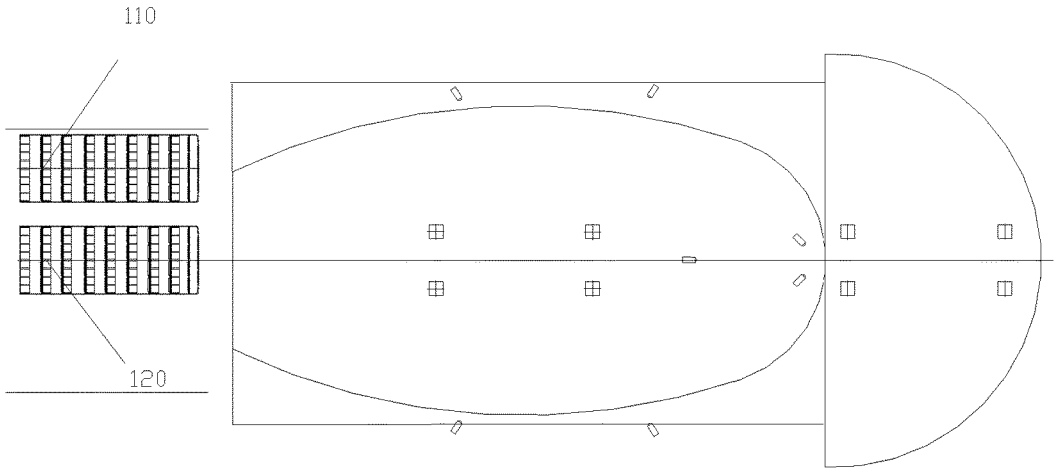
Figure 10:
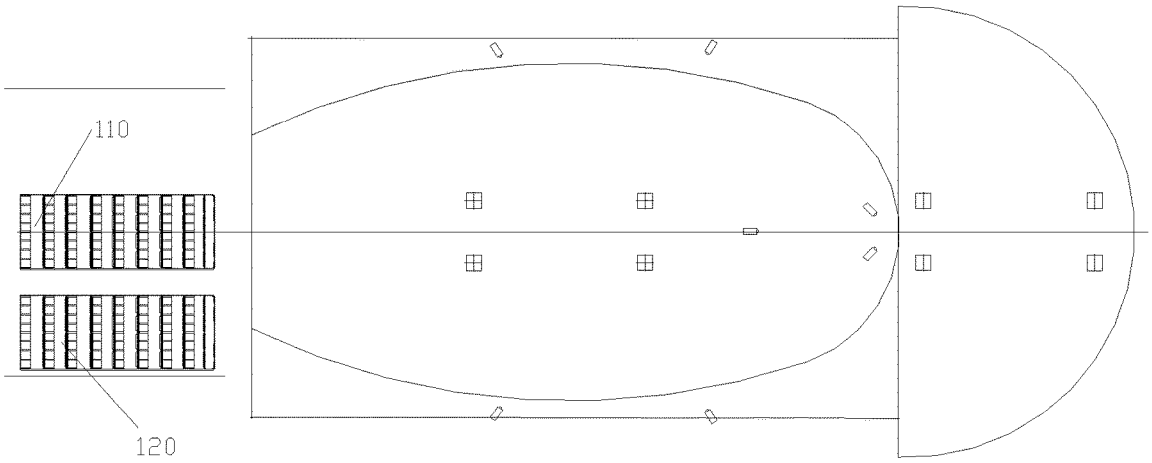

Referring FIG. 1 and FIG. 2, the present application has provided a circulating dynamic vehicle viewing system. In specific, the circulating dynamic vehicle viewing system at least comprises two circulating dynamic vehicles 100, i.e. a first circulating dynamic vehicle 110, a second circulating dynamic vehicle 120; a drive device used for driving the circulating dynamic vehicles in motion; a rocking platform used for controlling the circulating dynamic vehicles in reciprocating motion, i.e. a first rocking platform 200 and a second rocking platform 300. The first rocking platform 200 and the second rocking platform 300 are each provided with several independent motion platform apparatuses 210 used for securing the circulating dynamic vehicles 100. The independent motion platform apparatuses 210 are provided with an airbag apparatus used for controlling an up and down movement of the circulating dynamic vehicles.

Continue referring FIG. 1 and FIG. 2, by arranging a rocking platform provided with independent motion platform apparatuses having an airbag apparatus, the circulating dynamic vehicle travelling on the rocking platform can move upward, downward, leftward, rightward, forward and backward under the control of the drive device. Via the present embodiment, the audience sitting in the circulating dynamic vehicles 100 can simulate actions such as bumping, falling and thus having a sense of realism and stereo liveness.

The independent motion platform apparatus 210 refers to a platform apparatus which is arranged on the rocking platform but not affected by the rocking platform, and can have an independent motion. In specific, the independent motion platform apparatus 210 is a recess arrangement on the rocking platform. An airbag apparatus is arranged at the recess portion of the independent motion platform apparatus 210. When the circulating dynamic vehicle 100 travels to the independent motion platform apparatus 210, the independent motion platform apparatus 210 would lock out the wheels of the circulating dynamic vehicle 100. Then the circulating dynamic vehicle 100 can be moved upward, downward, leftward, rightward, forward, backward and so on via the up and down movement of the airbag apparatus and the reciprocating motion of the rocking platform.

Furthermore, the first rocking platform 200 is provided with a bracket screen 400 at its left side and its right side, respectively. The bracket screen 400 is arranged at the left and right sides of the first rocking platform 200, means that the bracket screen 400 is arranged at the left and right sides along the travelling direction of the circulating dynamic vehicle 100 on the first rocking platform 200. In additional, a ceiling 40 is arranged above the bracket screen 400, that is, the ceiling 40 is arranged above the first rocking platform 200. The ceiling is provided with several first projection apparatuses 10 for projecting onto the bracket screen 400. The audience sitting in the circulating dynamic vehicles 100 can watch the film shown by the bracket screens 400 at the left side and right side via the bracket screen 400 and the first projection apparatuses 10 for projecting onto the bracket screen 400. Meanwhile, the first rocking platform 200 can coordinate with the film content to implement the reciprocating motion, such that the circulating dynamic vehicle 100 on the first rocking platform 200 can implement the reciprocating motion, thus making the audience feeling immersive and real.

It is preferable that two first projection apparatuses 10 are arranged at the left side and the right side of the ceiling 40, respectively. In such a way the projection scope can be effectively expanded, the audience can be surrounded by the film, thus giving the audience reality and livenesss.

In additional, the first rocking platform 200 is further provided with an arc screen door 600 connecting the bracket screens 400 at its left side and right side. The first rocking platform and the second rocking platform are separated by the arc screen door 600. When the circulating dynamic vehicle 100 implements the reciprocating motion on the first rocking platform 200, the arc screen door 600 is closed. As the arc screen door 600 is a screen, the audience can watch films shown on the arc screen door 600, when the projection apparatus 300 arranged above and in front of the first rocking platform 200 projects at the arc screen door 600. When the audience in the circulating dynamic vehicle 100 has finished the film on the first rocking platform 200, the arc screen door 600 is opened, and then the circulating dynamic vehicle 100 enters the second rocking platform for continuing the film.

In the present embodiment, when the audience sits in the circulating dynamic vehicle 100 which is travelling on the first rocking platform 200, the film is playing at the left side and the right side via the bracket screen 400 and the arc screen door 600 having a certain radian. In such a way, screen pictures showing a fast running of a car can be simulated, so the audience can have a strong vision encapsulation feeling, thus having strong realistic feeling and livenesss. The realization principle of the technical proposal is that the combining of the low-speed operated circulating dynamic vehicle 100 and the high-speed operated screen pictures can make the audience feeling that the vehicle body travels fast. Moreover, the first projection apparatus 10 can be arranged on the ceiling above the bracket screens, such that the projection of the first projection apparatus 10 would not be sheltered by other obstacles, and the optimal projection range and effect can be obtained.

In additional, a hemispheric screen 500 is arranged above the second rocking platform 300. Furthermore, two second projection apparatuses 20 for projecting onto the hemispheric screen are arranged at the front of the ceiling. The hemispheric screen 500 can surround the left, right and front sides of the second rocking platform 300. When the circulating dynamic vehicle 100 travels to the second rocking platform 300, it would be surrounded by the film shown by the hemispheric screen 500. Coordinating with the film content such as the car rushing through or backward, the second rocking platform 300 implements the reciprocating motion, thus giving the audience sitting on the circulating dynamic vehicle 100 the feeling that they are sitting on a rushing car.

Specifically, a guide rail is arranged under the circulating dynamic vehicle 100. The circulating dynamic vehicle 100 is slidably connected to the guide rail and moves forward along the direction of the guide rail to pass the first rocking platform 200 and then enter the rocking platform 300.

In a preferred embodiment, the driving device is a wire rope traction device which drives the circulating dynamic vehicle 100 in motion via the wire rope. In additional, the driving device drives the circulating dynamic vehicle 100 in motion via a roller. In the present application, the wire rope traction device adopts a double-twisted wire rope. The twisting manner of the wire rope affects its flexibility a lot. The single-twisted wire rope has large flexibility, that is, more difficult to restore to the original state after a force has been applied. However, the three-twisted wire rope is difficult to produce and the formed wire rope is easy to be broken. The present application employs a double-twisted wire rope which is easy to produce and restore to the original state, and has small flexibility. In additional, the roller can be used to effectively increase the driving friction force of the driving device, so that the circulating dynamic vehicle 100 can travel smoothly on the rocking platform.

More preferably, the first rocking platform 200 is provided with four independent motion platforms 210, and the second rocking platform 300 is provided with four independent motion platforms 210, wherein the independent motion platforms 210 coordinate with wheels of the circulating dynamic vehicle 100 and secure the circulating dynamic vehicle 100. That is, each wheel of the circulating dynamic vehicle 100 is corresponding to one independent motion platform 210. When the independent motion platforms 210 lock out the wheels of the circulating dynamic vehicle 100, the airbag apparatus arranged in the independent motion platform 210 can move upward and downward, independently and respectively. In such a way, the circulating dynamic vehicle 100 can be brought to move upward, downward, leftward, rightward, forward and backward and so on.

When the circulating dynamic vehicle 100 travels to the first rocking platform 200, the first rocking platform 200 can implement a reciprocating movement along with the film content shown on the bracket screen 400 at its left side and its right side. The circulating dynamic vehicle 100 will implement the same reciprocating movement. When the circulating dynamic vehicle 100 travels to the middle of the first rocking platform 200, the independent motion platforms 210 on the first rocking platform 200 will lock out the wheels of the circulating dynamic vehicle 100 and secure the circulating dynamic vehicle 100. Then the airbag apparatus arranged in the independent motion platform 210 can move upward and downward via a compression and relaxation. Meanwhile, the circulating dynamic vehicle 100 can move upward, downward, leftward, rightward, forward and backward and so on along with the film content, when combining the up and down movement of the airbag apparatus and the reciprocating motion of the first rocking platform 200. When displaying screen pictures such as chasing or attacked by, or fighting with a monster or beast such that the car is impacted, vibrated or flipped, the impact vibration of the car during the rushing can be simulated, the audience can feel immersive, thus having strong realistic feeling and livenesss.

When the circulating dynamic vehicle 100 is unlocked by the independent motion platforms 210 on the first rocking platform 200, the circulating dynamic vehicle 100 continues moving forward to the second rocking platform 300. Specifically, the second rocking platform 300 is arranged to be upwardly inclined. When the circulating dynamic vehicle 100 enters into the second rocking platform 300 completely, the independent motion platforms 210 on the first rocking platform 200 would lock out the wheels of the circulating dynamic vehicle 100 similarly. Furthermore, the airbag apparatus and the second rocking platform 300 would function together to move the circulating dynamic vehicle 100 upward, downward, leftward, rightward, forward and backward and so on. The hemispheric screen 500 around the second rocking platform 300 would surround the audience on the circulating dynamic vehicle 100 by the film. Accordingly, the audience can have a big view angle and strong stereo feelings.

Please refer to FIG. 3-10, which are diagrams showing that the circulating dynamic vehicle enters the viewing system for viewing according to a preferable embodiment of the present application. Two circulating dynamic vehicles are arranged in the circulating dynamic vehicle viewing system, i.e. the first circulating dynamic vehicle 110 and the second circulating dynamic vehicle 120. When watching the film, the audiences firstly get in the second circulating dynamic vehicle 120 and then the second circulating dynamic vehicle 120 is driven to a middle position in the front of the first rocking platform 200. Then the first circulating dynamic vehicle 110 would let the audiences in. The front door of the circulating dynamic vehicle viewing system is opened. The second circulating dynamic vehicle 120 is driven to the middle position in the front of the first rocking platform 200 and is locked out by the independent motion platforms 210 on the first rocking platform 200 for securing. Then the first projection apparatus 10 for projecting onto the bracket screens 400 and the third projection apparatus 30 for projecting onto the arc screen door are turned on. The second circulating dynamic vehicle 120 coordinates with the film content to implement acrobatic actions, such as moving forward, backward, ascending, falling and so on. When the audience has finished the film on the first rocking platform 200, the third projection apparatus is turned off at first, and the arc screen door 600 is opened. The second projection apparatus 20 for projecting onto the hemispheric screen is turned on, and the first projection apparatus 10 is turned off. The second circulating dynamic vehicle 120 enters the second rocking platform 300 and coordinates with the film content to implement acrobatic actions such as moving forward, backward, ascending and falling and so on. When the audience has finished the film, the second circulating dynamic vehicle 120 returns back to the initial position, and the first circulating dynamic vehicle 110 is driven to the middle position in the front of the first rocking platform 200, and implements the same view process as the second circulating dynamic vehicle. By implementing the circulating dynamic vehicle viewing system according to the present application, the audience sitting in the circulating dynamic vehicles 100 can simulate actions such as bumping, falling and thus having a sense of realism and stereo liveness. Moreover, the first circulating dynamic vehicle 110 and the second circulating dynamic vehicle 120 can be used for film viewing alternatively, so the viewing experience can be provided to more audiences. Accordingly, the circulating dynamic vehicle viewing system according to the present application has high utilization efficiency.

It should be noted that, the present application is not limited to above embodiments. Alternative modification and change will become apparent to those skilled in the art to which the present application pertains without departing from its spirit and scope.

What is claimed is:

1. A circulating dynamic vehicle viewing system at least comprising: two circulating dynamic vehicles, i.e. a first circulating dynamic vehicle, a second circulating dynamic vehicle; a drive device used for driving the circulating dynamic vehicles in motion; a rocking platform used for controlling the circulating dynamic vehicles in reciprocating motion, i.e. a first rocking platform and a second rocking platform; wherein the first rocking platform and the second rocking platform are each provided with several independent motion platform apparatuses used for securing the circulating dynamic vehicles; wherein the independent motion platform apparatuses are provided with an airbag apparatus (211) used for controlling an up and down movement of the circulating dynamic vehicles.

2. The circulating dynamic vehicle viewing system according to claim 1, wherein, the first rocking platform is provided with a bracket screen at its left side and its right side, respectively, and the first rocking platform is further provided with an arc screen door connecting the bracket screens at its right side and left side.

3. The circulating dynamic vehicle viewing system according to claim 1, wherein, the second rocking platform is provided with a hemispheric screen.

4. The circulating dynamic vehicle viewing system according to claim 1, wherein, the first rocking platform is provided with a ceiling on which several projection apparatuses for projecting are arranged, i.e. a first projection apparatus, a second projection apparatus, and a third projection apparatus.

5. The circulating dynamic vehicle viewing system according to claim 4, wherein, two of the first projection apparatuses for projecting onto a bracket screen are arranged at the left side and the right side of the ceiling, respectively.

6. The circulating dynamic vehicle viewing system according to claim 4, wherein, two of the second projection apparatuses for projecting onto a hemispheric screen are arranged at the front of the ceiling.

7. The circulating dynamic vehicle viewing system according to claim 4, wherein, the third projection apparatus for projecting onto an arc screen door is arranged at a middle position of the front of the ceiling.

8. The circulating dynamic vehicle viewing system according to claim 1, wherein, a guide rail is arranged under the circulating dynamic vehicles which are slidably connected to the guide rail.

9. The circulating dynamic vehicle viewing system according to claim 1, wherein, the first rocking platform is provided with four independent motion platforms, and the second rocking platform is provided with four independent motion platforms, wherein the independent motion platforms coordinate with wheels of the circulating dynamic vehicles for securing the circulating dynamic vehicles.

10. The circulating dynamic vehicle viewing system according to claim 1, wherein, the drive device is used for driving the circulating dynamic vehicles in motion via a roller.

* * * * *